US005205596A

United States Patent [19]

Ralph

[11] Patent Number: 5,205,596

[45] Date of Patent: Apr. 27, 1993

[54] DOOR LATCH MEMBER

[75] Inventor: James L. Ralph, Shoreview, Minn.

[73] Assignee: Cole-Sewell Corporation, St. Paul, Minn.

[21] Appl. No.: 934,241

[22] Filed: Aug. 24, 1992

[51] Int. Cl.[5] ..... E05C 3/14

[52] U.S. Cl. ..... 292/336.3; 292/224

[58] Field of Search ..... 292/60, 169, 169.21, 292/172, 336.3, DIG. 27, 224; 70/107, 134, 143, 472

[56] References Cited

U.S. PATENT DOCUMENTS

| | | | |
|---|---|---|---|
| 1,661,454 | 3/1928 | Wilson | 292/1.5 X |
| 2,290,727 | 7/1942 | Best | 292/172 |
| 3,159,994 | 12/1964 | Schulz | 292/60 X |
| 4,333,324 | 6/1982 | Dietrich et al. | 292/DIG. 27 X |
| 4,569,547 | 2/1986 | Fayerman et al. | 292/347 |
| 4,601,499 | 7/1986 | Kim | 292/36 |
| 4,796,930 | 1/1989 | Baynes | 292/58 |
| 4,915,432 | 4/1990 | Gressett, Jr. | 292/336.3 |
| 4,925,222 | 5/1990 | Loock | 292/336.3 |
| 4,934,800 | 6/1990 | Choi | 292/172 |
| 4,988,136 | 1/1991 | Gressett, Jr. | 292/336.3 |

*Primary Examiner*—Richard E. Moore
*Attorney, Agent, or Firm*—Leo Gregory

[57] ABSTRACT

A door latching assembly in which the latch operator has a unique camming member which retracts the latch member upon operation of the latching handle member, the cam action is one of rotation having a rolling contact with a spring loaded sliding fork member whereas the rolling cam and its contact point on the sliding fork after very appreciable usage shows no indication of wear.

2 Claims, 3 Drawing Sheets

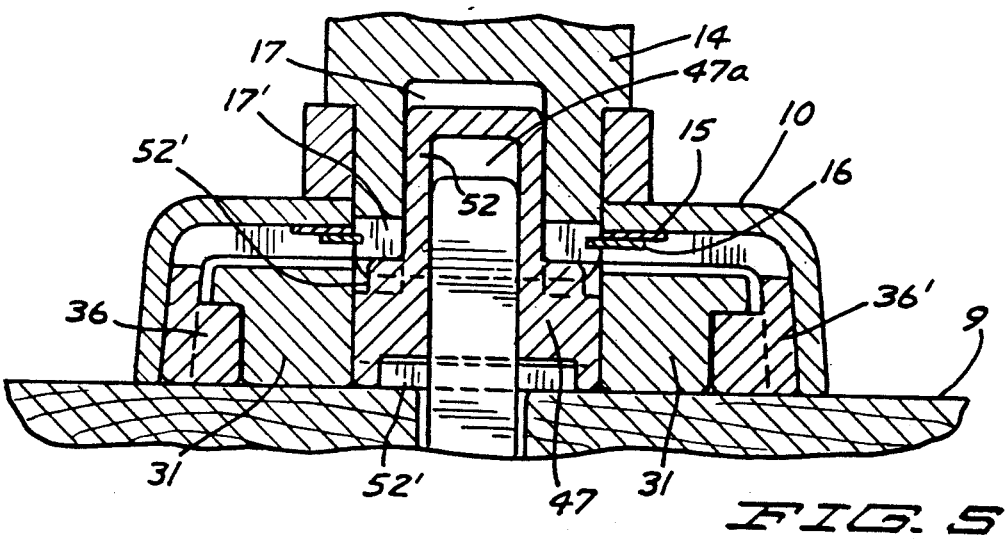
FIG. 5
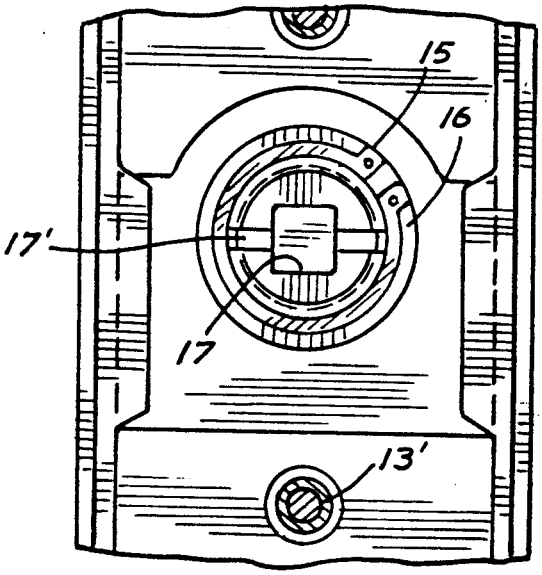
FIG. 6
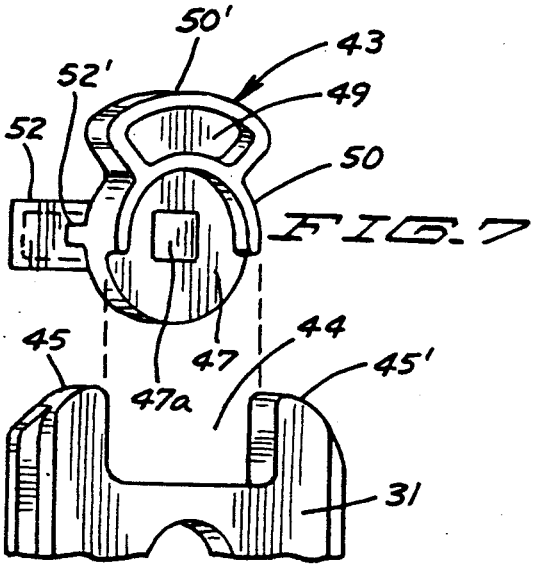
FIG. 7
FIG. 8
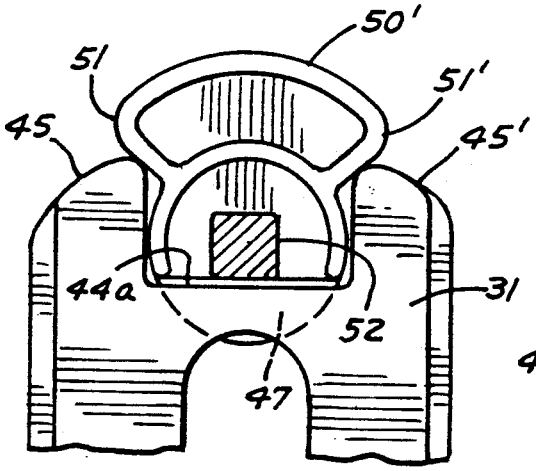
FIG. 9
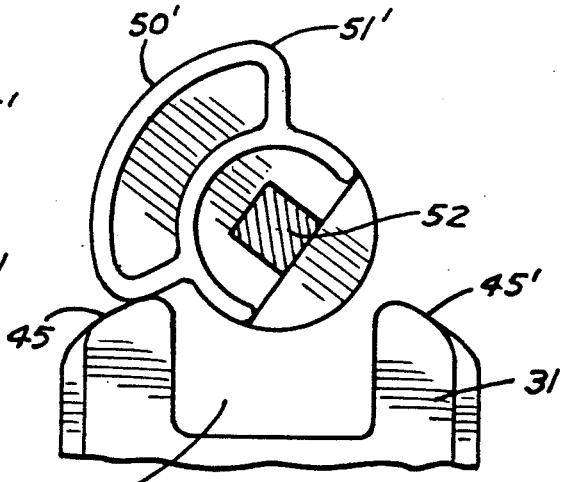
FIG. 10

DOOR LATCH MEMBER

BACKGROUND OF THE INVENTION

1. Field of Invention

This invention relates to door latch members.

2. Description of Previous Art

Door latch assemblies involve the use of cam members to actuate the latch operating members. Cam action in general is a sliding action of two engaging surfaces. In time and particularly with as much use as a latch member is given, the engaging cam surfaces tend to indicate wear.

Of the prior art, a fairly close reference is the Loock U.S. Pat. No. 4,925,222 which has a pair of parallel compression springs which alternately act upon a pair of plungers which in turn are displaced by a rotary member having a pair of shoulders to engage the plungers.

In U.S. Pat. No. 5,029,913 there is shown a semi-circular cam which serves as a latch retractor. In U.S. Pat. No. 945,276 a latch member includes a hub with a pair of extended arms to actuate the latch retracting member. In Choi U.S. Pat. No. 4,934,800 the retracting member has a curved concave edge portion engaged by the convex edged cam member 55.

The above patents appear to be representative of the prior art.

SUMMARY OF THE INVENTION

It is a purpose of the invention herein to provide a latch member having a cam operating action which engages a plunger latch operating member in such a manner that there is a minimum of contact between the engaging surfaces and that no appreciable wear results from their interengagement.

In other respects the latch member is of a simplified construction with few movable parts and with a positive latching engagement.

These and other objects and advantages of the invention will be set forth in the following description made in connection with the accompanying drawings in which the reference characters refer to similar parts throughout the several views.

BRIEF DESCRIPTION OF THE DRAWINGS

FIG. 5 is a broken view in section taken on line 5—5 of FIG. 3 as indicated;

FIG. 6 is a broken view in elevation showing a detail of structure;

FIG. 7 is a view in perspective of a cam acting member;

FIG. 8 is a broken view in perspective of a cam follower relating the structure of FIG. 7;

FIG. 9 is a view in front elevation showing the structure of FIGS. 7 and 8 in one operating position; and FIG. 10 is a view similar to that of FIG. 9 showing another operating position;

DESCRIPTION OF A PREFERRED EMBODIMENT

Figure 3:
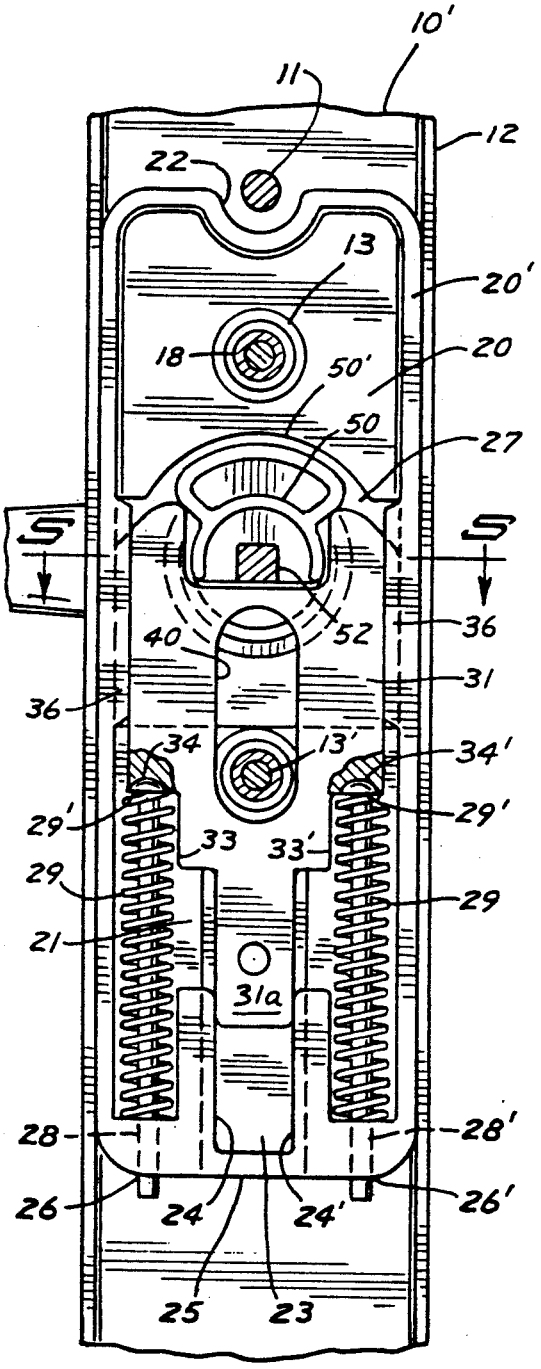
FIG. 3 is a view in vertical section showing one operating position.
Figure 4:
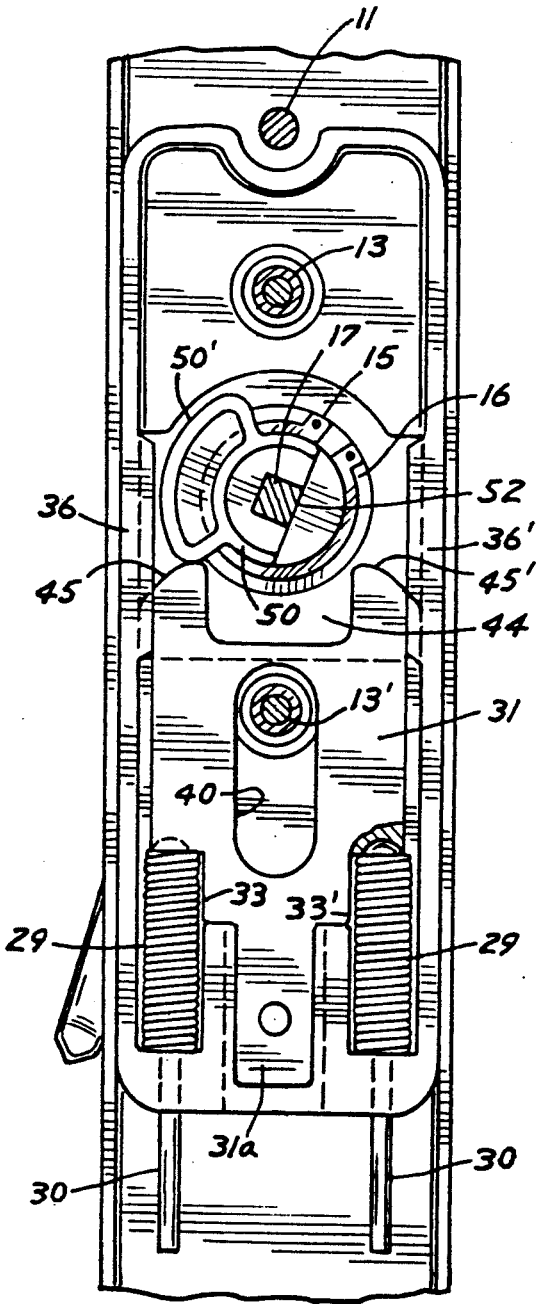
FIG. 4 is a view similar to that of FIG. 3 showing another operating position.

Referring to the FIGS., shown at 10 is an outer housing referred to as an escutcheon plate which is an elongated oval having an inwardly turned up rim 12 thereabout as indicated in FIGS. 3 and 4.

Said plate is shown secured by screws 11 and 11' to a door 9.

The structure comprising the novelty herein is disposed within said escutcheon plate 10 as indicated particularly in FIGS. 3 and 4. At the inner side of said door is an inside handle 3 which is connected for rotation to an outer side handle 14 by a spindle 4 and said inside handle has integral therewith a latch member 5 which engages a strike member 6 secured to an adjacent door jamb 7.

Said outer operating handle 14 which may be formed as illustrated or may be otherwise as in the shape of a knob. Said handle is secured at the inner side of said plate 12 by a retaining ring 15 (FIG. 6) at an inward projection 16 of said handle and said inward projection indicates a recess 17 into said handle, said recess being rectangular in cross section to receive a latch operator as will be described and across the outer face of said recess is a transverse positioning slot 17' of small depth.

Upstanding from the inner side 10' of said plate member 10 are a pair of longitudinally spaced screw posts 13 and 13' which will be disposed into appropriate openings in said door and secured by screws threaded therein from the inner side of said door and not here shown.

Disposed within the inner side of said plate member 10 and apertured to fit over said screw posts 13 and 13' is an inner seated plate member 20 which is shown as a cast plate member in the general form of an elongated rectangle for a substantial length of said plate 10 and the same is retained by a conventional star retainer 18 disposed over the post 13.

Said inner plate member has an upstanding rim 20' thereabout and has at the upper end thereof a curved indenture 22 to avoid the screw 11.

At the lower portion of said inner plate member 20 is a rectangular slot opening 23 having upstanding walls 24 and 24' at each side thereof and the end wall 25 thereof has 26 and 26' therethrough respectively centered between said walls 24 and 24' and the adjacent outer rim of said inner plate member.

The upper central portion 27 of said inner plate member is cut out as shown.

In the bottom wall 21 of said inner plate member in alignment with said holes 26 and 26' are longitudinal grooves 28 and 28'. Respectively disposed in said grooves are coiled compression springs 29 and extending respectively through each of said coil springs are headed pins 30 extending through said holes 26 and 26'.

Disposed to be positioned onto said inner plate member is a sliding plate 31 having a forwardly extending tongue portion **31*a* to slidingly extend between said walls 24 and 24'**.

Said plate member is offset at each side of said tongue as at 33 and 33' with indentations 34 and 34' in the end walls thereof to seat the head portions 29' of the pins 29.

Overlying wall portions 36 and 36' extend inwardly from each side of said rim portion 20' of said inner plate to retain said sliding plate 31. The central portion of said sliding plate has an elongated slot 40 which overlies said screw post 13' and permits said plate to have longitudinal sliding movement.

The upper central portion of said sliding plate 31 has a U-shaped indenture or forked opening 44 as shown in FIGS. 8–11. Formed at each side of said opening are cam lobes 45 and 45'. These lobes have outwardly downwardly curved or sloping wall portions forming radiused ends making up said cam lobes. The radius of each lobe is an essential element of novelty. Said sliding plate will be referred to as a sliding fork.

Disposed or seated in said opening 44 is a spindle cam adapter 43 which has a cylindrical body portion 47 disposed at right angles to said sliding plate 31 and is partially received into said U-shaped forked opening 44. Extending forwardly from the upper portion 49 of said adapter is a semicircular or arcuate projection 50.

Projecting upwardly of said top portion 49 of said adapter is an arcuate projection 50' which has radiused or rolling surfaced ends 51 and 51', the curvature of which extends inwardly of itself, as shown in FIGS. 8–10, to merge into the sides of said top portion 50.

Said cylindrical body portion has an axial projection or shaft 52, rectangular in cross section, which is disposed into the recess 17 of said handle 14 as said adapter is seated into said forked opening 44 with the end portions of the arcuate projection resting upon said cam lobes 45 and 45'. As shown in FIG. 9, the projection 50 rests upon the bottom wall 44*a* of said opening 44 and the depending portion of the cylinder 47 is behind the plate member 31 as seen in FIG. 9.

Figure 1:
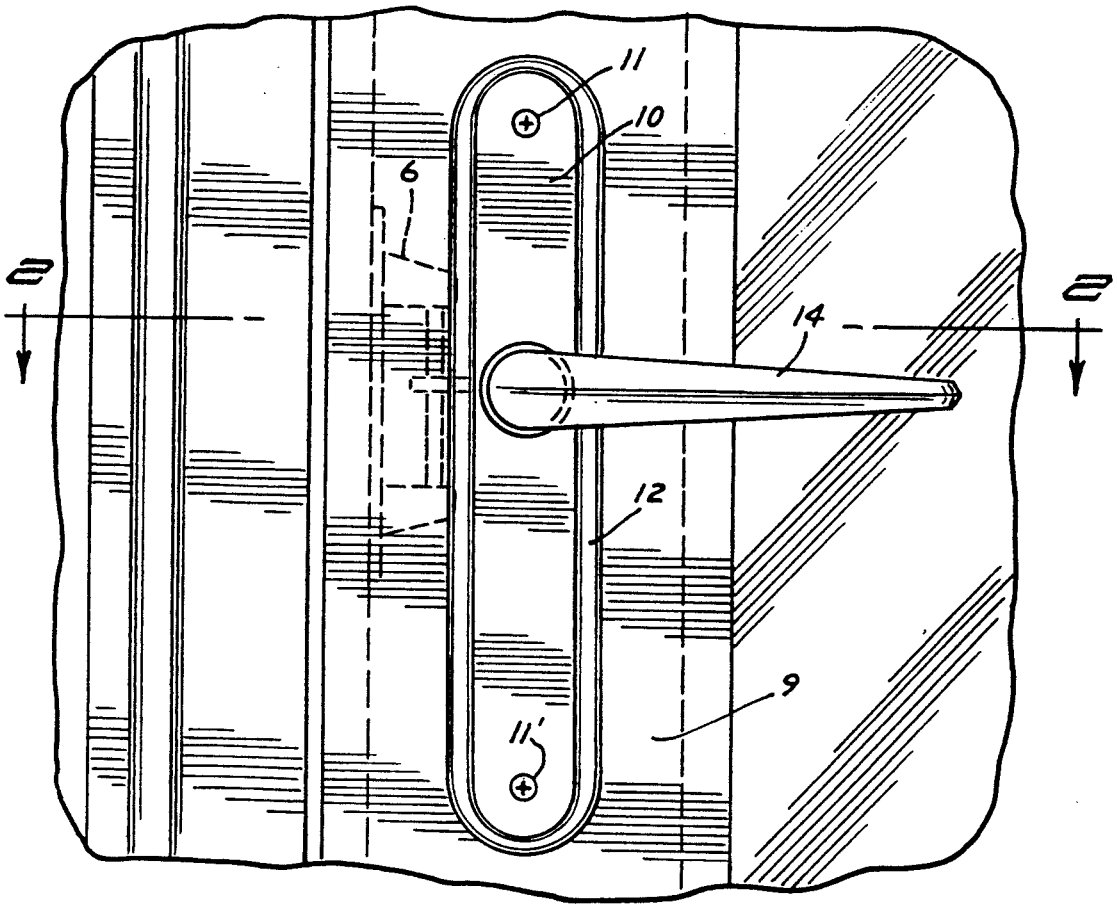
FIG. 1 is a view in front elevation in operating position with a portion thereof in dotted line.
Figure 2:
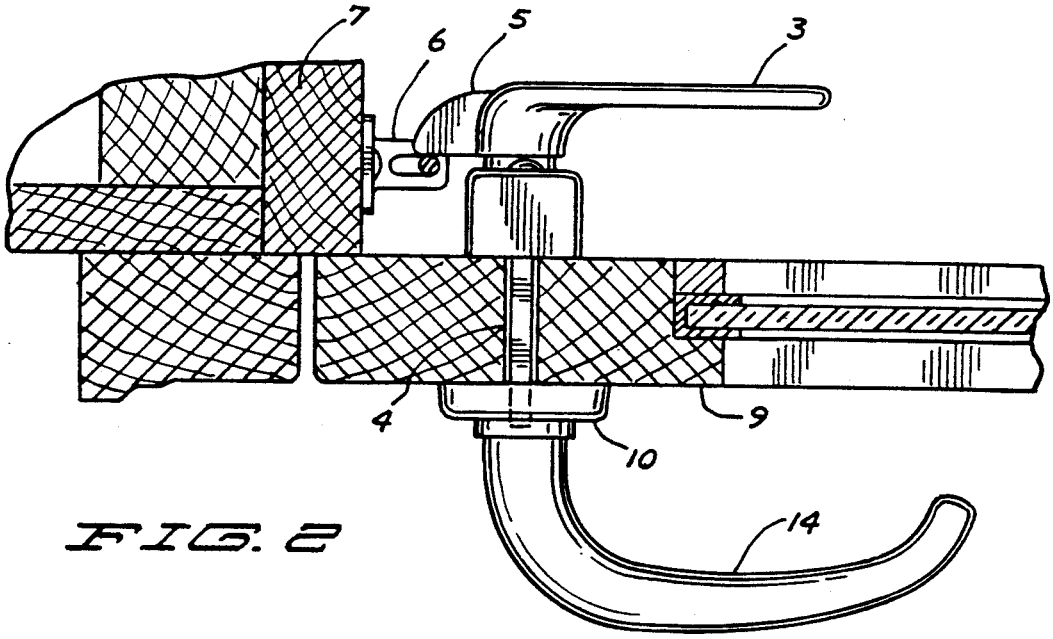
FIG. 2 is a view in horizontal section taken on line 2—2 of FIG. 1 as indicated.

With the shaft 52 positioned into said handle recess 17, it is seen that said adapter is operated or rotated by the rotation of said handles 14 or 3. Said adapter may be referred to as a spindle cam. It is noted in FIG. 2 that the handles are connected by the shaft or spindle 4 and said adapter.

The essential element of novelty in the operation of the latch structure herein is present in the particular cam acting relationship between the cam adapter 43 and its engagement of its cam ends 51 and 51' with the cam lobes 45 and 45'.

In the conventional engagement of two cam surfaces, the engagement is between two flat surfaces with full surface engagement. Here the engagement is between two curved surfaces as a result of which there is a rolling engagement with only a line contact between the engaging bodies.

This rolling engagement with successive line contacts has proved so successful that in 50,000 operations, there has been no measurable wear between the engaging members. This successful result is an unheard of result between engaging surfaces.

The remaining operation of the latch member is fairly conventional. The rotation of the handle in rotating the adapter 43 causes the plate member to compress the springs 29 to withdraw from engagement with the strike member 6 to permit the door to be opened and upon release of the handle, the latch member is returned to again engage the strike member as the door is closed.

The success achieved with the novel cam engagement described has made possible a practically service free latch structure.

It will of course be understood that various changes may be made in form, details, arrangement and proportions of the parts without departing from the scope of the invention herein which, generally stated, consists in an apparatus capable of carrying out the objects above set forth, in the parts and combination of parts disclosed and defined in the appended claims.

What is claimed is:

1. A latch structure for a door, comprising an elongated plate member mounted onto the outer side of a door, a handle attached to said plate member having a recessed inner end portion extending through said plate member, an adapter at the inner side of said plate member having a shaft extending into said recess of said handle to be rotated by said handle, a spindle extending from said adapter to a latch member to operate the same, a spring engaged sliding plate member mounted onto the inner side of said plate member, said plate member having a U-shaped forked opening at one end thereof adjacent said adapter, said adapter having a cylindrical body portion disposed at right tangles to the plane of said U-shaped opening, a forward semi-circular projection from the upper cylindrical portion of said body portion of said adapter seated into said opening, the lower cylindrical portion of said adapter being disposed at the rear of said sliding plate member, shoulders at each side of said opening forming radiused cam lobes, said adapter seated into said opening having an upward arcuate projection having its respective end portions radiused to form cam lobes, the same resting upon said first mentioned cam lobes, whereby a rotation of said handle actuates said adapter causing a cam lobe thereof to engage the adjacent first mentioned cam lobes in a rolling cam action wherein the adjacent cam surfaces have only a line engagement reducing the engagement to one resulting in no appreciable wear.

2. A latch structure for a door, comprising an elongated plate member mounted onto the outer side of a door, a handle attached to said plate member having a recessed inner end portion extending through said plate, an adapter at the inner side of said plate member having a shaft extending into said recess of said handle to be rotated by said handle, said recess into said handle has a cross slot therein at the face thereof, said shaft of said adapter has a projection at either side thereof to seat into said cross slot to correctly position said adapter, a spindle extending from said adapter to a latch member to operate the same, a spring engaged sliding plate member mounted onto the inner side of said plate member, said plate member having a U-shaped forked opening at one end thereof adjacent said adapter, shoulders at each side of said opening forming radiused cam lobes, said adapter being seated into said opening and having an upward arcuate projection having its respective end portions radiused to form cam lobes, the same resting upon said first mentioned cam lobes, whereby a rotation of said handle actuates said adapter causing a cam lobe thereof to engage the adjacent first mentioned cam lobes in a rolling cam action wherein the adjacent cam surfaces have only a line engagement reducing the engagement to one resulting in no appreciable wear.

* * * * *